US005601658A

United States Patent [19]

Marinas et al.

[11] Patent Number: 5,601,658

[45] Date of Patent: Feb. 11, 1997

[54] METHOD OF TREATING LEAD-CONTAINING SURFACES TO PASSIVATE THE SURFACE LEAD

[75] Inventors: Benito J. Marinas, Champaign; Connie Bogard, Kildeer, both of Ill.; Yi Jiang; Hsin-Ting Lan, both of West Lafayette, Ind.

[73] Assignee: Purdue Research Foundation, West Lafayette, Ind.

[21] Appl. No.: 497,216

[22] Filed: Jun. 30, 1995

[51] Int. Cl.$^6$ ..... C23G 1/10

[52] U.S. Cl. ..... 134/3; 148/553; 75/743; 216/105; 216/106

[58] Field of Search ..... 216/105, 106; 75/743; 148/553; 134/3

[56] References Cited

U.S. PATENT DOCUMENTS 5,454,876 10/1995 Downey ..... 134/3

OTHER PUBLICATIONS

Control of Lead Contamination in Drinking Water From Brass Plumbing Fixtures, Connie L. Bogard, Purdue University Graduate School Thesis, Mar., 1992.

Lead, Water Bad Mix, Joe Gerrety, Journal and Courier, Aug., 1993.

Lifeline for newborns (Simple Process Removes Lead From Faucets), Ron Kotulak, The Chicago Tribune, Sep., 1993.

Off The Record, Jim Olsztynski, PHC Profit Report, Oct., 1993.

Ion–Exchange Treatment of Spent Brass Fixture "Deleadification" Solution, abstract from Proceedings of the 49th Industrial Waste Conference, May, 1994.

Getting the Lead Out, Lisa Hunt Tally, Civil Engineering Transitions Newsletter, Purdue University, Summer 1994.

Drinking Water System Components Health Effects, NSF International Standard, NSF 61, Section 9, Dec., 1994.

*Primary Examiner*—Sam Silverberg

*Attorney, Agent, or Firm*— Laff, Whitesel, Conte & Saret, Ltd.

[57] ABSTRACT

A method for treating bronze or brass fixtures containing lead with a cupric acetate solution is described. The treatment results in decreased amounts of lead in subsequent use. A preferred embodiment uses about 0.01 M cupric acetate at pH4.

26 Claims, 8 Drawing Sheets

METHOD OF TREATING LEAD-CONTAINING SURFACES TO PASSIVATE THE SURFACE LEAD

BACKGROUND OF THE INVENTION

For many years, various materials which contain lead have come in contact with foods and liquids intended for human consumption. Such lead-containing materials include brass alloys made of copper, lead, and zinc used for plumbing fittings; bronze alloys; lead solder in pipes; lead-containing compounds used in tins for storing food items such as olive oil; etc.

Brass alloys used to manufacture fittings such as faucets and valves are made up primarily of copper and zinc, with a small amount of lead added to make the brass more workable and machinable. Easier machinability permits finishing, machining, the cutting of threads, etc., to proceed more smoothly and at a lower cost than without a lead alloying moiety. Bronze alloys are similarly made up primarily of copper and tin, with a small amount of a lead alloying moiety for similar reasons.

Because lead atoms are much larger than copper and zinc atoms, the lead atoms have very low solid solubility in brass alloys. The lead atoms therefore tend to precipitate as lead-rich pockets dispersed through the brass. Surfaces of brass fixtures generally have lead concentrations much higher than the average concentration of lead throughout the fixtures. These lead-rich pockets improve the machinability of the bronze. However, they also increase the tendency of lead to leach into water.

Until recently, the amount of lead leached into foods and liquids from modern lead-containing plumbing fittings was considered to be low enough that it presented no significant harm to ingesters of such foods and liquids. However, new, stricter standards which significantly limit the amount of permitted lead leaching and lead exposure are being promulgated and imposed at both the state and federal levels. For example, the Safe Drinking Water Act was amended in June 1988 to limit lead in solders and fluxes to 0.2 percent and to limit lead in public water supply pipe and fittings to eight percent. Lead soldered food cans have not been made in the United States since 1991. Regulations such as these limit lead exposure by limiting the amounts of lead in materials in contact with foods and liquids.

Another approach to limiting lead exposure is to limit the amount of lead which is actually in the food or water. For example, regulations implementing California's Safe Drinking Water and Toxic Enforcement Act of 1986 limit lead exposure of an individual to less than 0.5 microgram per day. In 1991, the EPA increased the stringency of the lead standard for drinking water from 50 parts per billion to 15 parts per billion. In December 1994, a consortium led by NSF International developed a voluntary third-party consensus standard, NSF Standard 61, Section 9-1994, and a certification program for all direct and indirect drinking water additives. Among these standards is one for lead, which limits the amount of lead from most endpoint devices to 11 micrograms (μg) when normalized for the one liter first draw sample.

Although the amount of lead leached from brass alloy faucets, valves and other plumbing fittings and fixtures made using current methods is low, the amount of lead leached from such fittings may exceed current or planned permissible standards. Such more stringent standards require either that lead be entirely eliminated from the brass alloys or that the brass be treated so that lead does not leach out in amounts which exceed permitted standards. Treatment of a material to reduce its chemical activity is sometimes referred to as passivation.

Previous lead control strategies recommended in the Lead and Copper Rule, 40 CFR §§141–142 (U.S. EPA 1991) have focused on water stabilization and corrosion inhibition. These treatments do not remove lead, but merely precipitate it or change its oxidation kinetics.

To stabilize water, its pH is adjusted, using, for example, lime (CaO), slaked lime ($Ca(OH)_2$), and caustics (NaOH, KOH). Alternatively, the alkalinity of water is adjusted, using, for example, sodium bicarbonate, sodium carbonate, and sodium silicate.

To inhibit corrosion, various inorganic phosphate salts and sodium silicate may be added. Zinc and other orthophosphates, sodium pyrophosphate, and sodium tripolyphosphate have been used. Phosphate treatment is not effective in low pH water. Polyphosphates apparently contain or convert to orthophosphates which form metal orthophosphate films on plumbing materials. Although sodium silicate inhibits corrosion of galvanized steel and copper-based metals by forming metal silicate films, it requires high doses and months of treatment to be effective against lead leaching.

It has been recently suggested that brass fittings be treated in a very low pH copper chloride bath to reduce the rate of lead leaching from the fittings during consumer use. It was thought that this treatment would mimic the process occurring in situ over many years. However, the efficacy of this treatment has been somewhat erratic. The copper chloride concentration ranged from 1 millimolar (mM) to 100 mM, while the preferred pH was a pH of 2.0. This very low pH may unduly endanger workers' safety. During treatment, the pH increased to non-preferred ranges, becoming less effective.

Copper chloride treatments have been found to have other serious disadvantages, including: the treatments are non-specific and inefficient, resulting in high amounts of zinc leached as well as lead; insufficient amounts of lead are leached; and the treatments are corrosive, with the low pH adversely affecting the treatment facilities.

It has been discovered that immersing or otherwise exposing the lead-containing surfaces of brass plumbing fittings to a bath of 1 mM copper (cupric) acetate ($CuAc_2$) to 100 mM $CuAc_2$, for a period of at least about five minutes, will effectively, efficiently and consistently reduce the lead leached into water to substantially less than the normalized 11 μg called for by the NSF International consensus standard of December 1994.

SUMMARY OF THE INVENTION

In accordance with the present invention, an improved method of treating a lead-containing surface to be exposed to potable water to reduce the availability of lead to be removed or leached therefrom is provided. It comprises the steps of providing a $CuAc_2$ solution, subjecting the lead-containing surface to the $CuAc_2$ solution for a period of at least about 5 minutes, and washing the surface to remove the $CuAc_2$ solution.

In a preferred form the lead-containing surface is subjected to the $CuAc_2$ solution for a period of at least 20 minutes. A pH of at least 3 is used. Preferably the pH is in the range of from about 3 to 5 and more desirably is about 3.5 to 4.5. A pH of about 4 is most preferably used. In a preferred practice of the method the lead-containing surface is subjected to a recirculating $CuAc_2$ solution with an initial $CuAc_2$ molar concentration of at least 0.001M, but less than 0.0.5M, and more preferably at least 0.01M, but less than 0.02M. The method is most preferably applied to brass fittings and to the interior surfaces thereof. To enhance the efficiency and efficacy of the process, the $CuAc_2$ solution is regenerated using an ion exchange column, with copper initially occupying the exchange sites.

The recirculating solution is preferably in the form of a circulating or immersion bath, and desirably employs an ion-exchange column to replace any lead which has been removed from the plumbing fitting into the $CuAc_2$ bath with copper, thereby regenerating the treatment solution. The pH may range from pH 3 to pH 5, more preferably from pH 3.5 to pH 4.5, with a pH of 4 being most preferred. It is believed that this treatment oxidizes metallic lead in the fitting surfaces, that the oxidized lead dissolves into the copper acetate bath, and that the lead in the fitting surfaces is replaced by more stable metallic copper as illustrated in FIG. 5. As a result, a passivated, stable, lead-depleted and copper-enriched surface is formed. Thus, lead leaching is decreased significantly.

Further objects, features and advantages of the present invention will become apparent from the following description and drawings.

DESCRIPTION OF A PRESENTLY PREFERRED EMBODIMENT OF THE INVENTION

In accordance with the present invention, an improved process for treating a lead-containing brass plumbing fitting is provided. The process comprises the steps of providing a $CuAc_2$ solution, removing as well as passivating the lead in exposed interior surfaces of brass fittings by contacting those surfaces with the $CuAc_2$ solution for a period of at least about five minutes, and then washing the exposed surfaces.

Typical lead-containing brass alloy fittings may contain 64–88% copper, 5–35% zinc, and 1–7% lead, but these percentages may vary over even wider ranges. Plumbing fittings for potable water may not exceed 8% lead to fall within the 1986 Amendments of the Safe Drinking Water Act. A brass fitting is usually cast and then machined. The lead provides a certain malleability, better enabling machining of the fitting. After machining, the outer surfaces are often, but not always, plated with chrome or other materials. However, the interior is generally not plated.

It is, of course, the interior of the fitting which is exposed to drinking water as the water passes through the fitting to the eventual consumer.

The process of the present application is also lead-specific, i.e., specific to lead with little dezincification. Thus, the process of the present invention, it is believed, satisfies the current needs for the treatment of brass fittings to permit them to be safely used as determined by the newly proposed standards.

Figure 6:
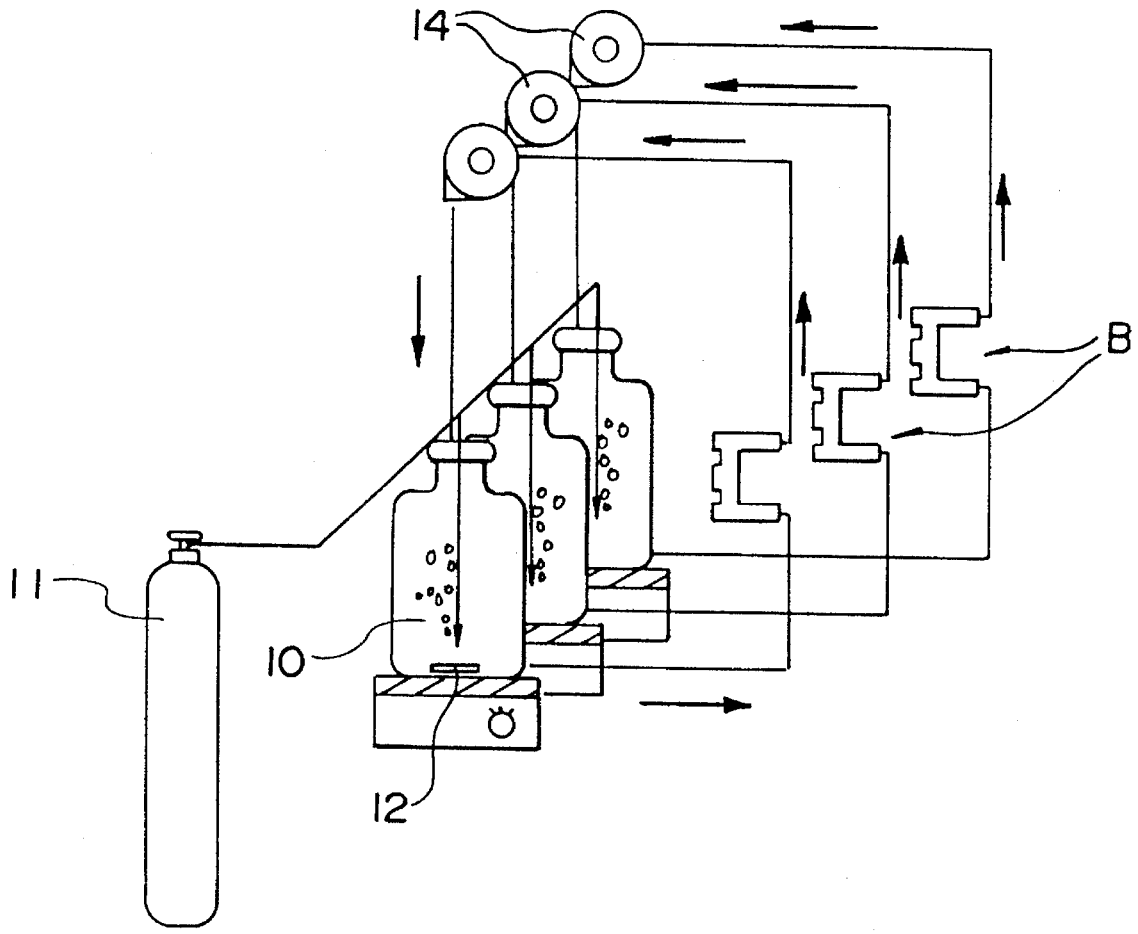
FIG. 6 is a schematic of a closed loop dynamic treatment apparatus.

A number of tests were conducted to determine the efficacy of treating brass fittings with $CuAc_2$ solutions. A closed loop dynamic treatment apparatus was set up, as shown in FIG. 6, by which containers 10 of treatment solution were filled with the $CuAc_2$ solution. The solution was maintained in a mixed state by magnetic stirrers 12. Nitrogen gas 11 was optionally introduced into the containers 10, and the treating solution was drawn through brass fixture bodies B by peristaltic pumps 14 and returned to the treating solution containers. Single pass dynamic treatments used a similar apparatus, but the treating solution was not returned to the containers 10.

EXAMPLE 1

Brass fixture bodies were treated dynamically with 20 liters of a recirculating copper acetate ($Cu(CH_3COO)_2 \cdot H_2O$) solution at about 23° C. at a pH of 4.0 in an apparatus of FIG. 6.

Treatment solutions were prepared inside glass bottles each containing a volume of 20 L (about 500 times fixture internal volume of 40 mL) in order to maintain approximately constant Cu(II) concentration throughout treatment. Solutions were continuously stirred at 300 rpm and optionally purged with nitrogen gas inside the tanks before and during treatment to eliminate any interference by dissolved oxygen and carbon dioxide. A multi-head peristaltic pump was used to circulate treatment solution from each bottle through a single fixture body and back into the bottle at a flow rate of 125±5 mL/min. The average hydraulic retention time of treatment solution inside the faucet body was about 20 seconds. Fixtures were connected to glass bottles and peristaltic pumps via polytetrafluoroethylene tubing. Samples were collected from either the fixture body effluent line or from inside the treatment solution reservoir at various times.

Fixtures were rinsed with deionized water before exposure to treatment solutions. Throughout the experiment, 20 mL samples were taken from the glass bottles at various times for a total period of up to 120 hours. Samples were analyzed for pH, and for copper, zinc and lead concentrations.

All chemicals used were reagent grade and all aqueous solutions were prepared with deionized water generated from a Barnstead Nanopure water system producing water with a 16–18 MΩ-cm resistivity.

For most experiments, the treatment solutions were subsequently returned back to the treatment solution reservoirs (i.e., closed loop operation). Other dynamic experiments were performed without circulation to maintain the lead concentration entering the fixture bodies equal to zero for the entire duration of the tests.

Ten liters of treatment solutions were prepared inside glass bottles for each single pass testing. Solutions were well mixed, and pumped through brass fixture body at a flow rate of 125 mL/min. 10 mL of samples were taken each time directly from effluent line of fixture body at various times.

Figure 3A:
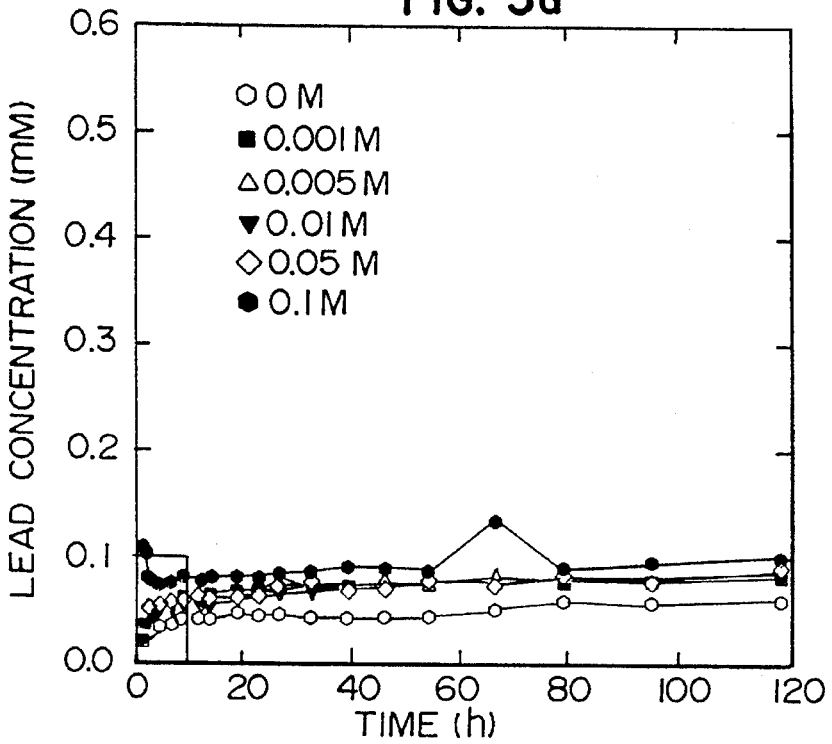
FIGS. 3(*a*) and 3(*b*) illustrate dissolved lead(II) concentrations observed during treatment of brass fixture bodies with various cupric acetate/acetic acid and acetic acid solutions (pH 4) under closed loop dynamic conditions.
Figure 3B:
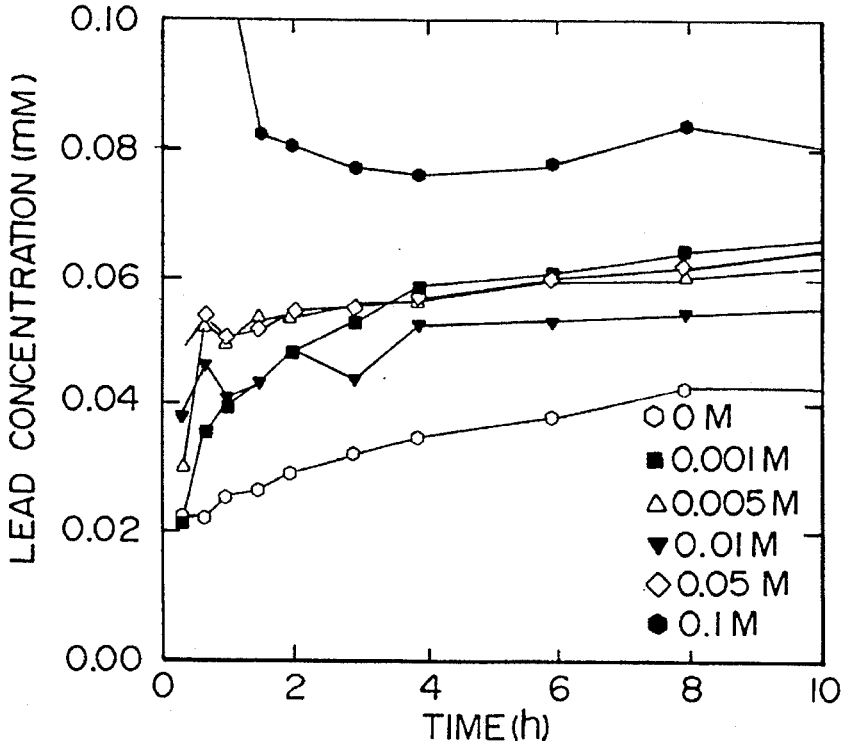
Figure 4A:
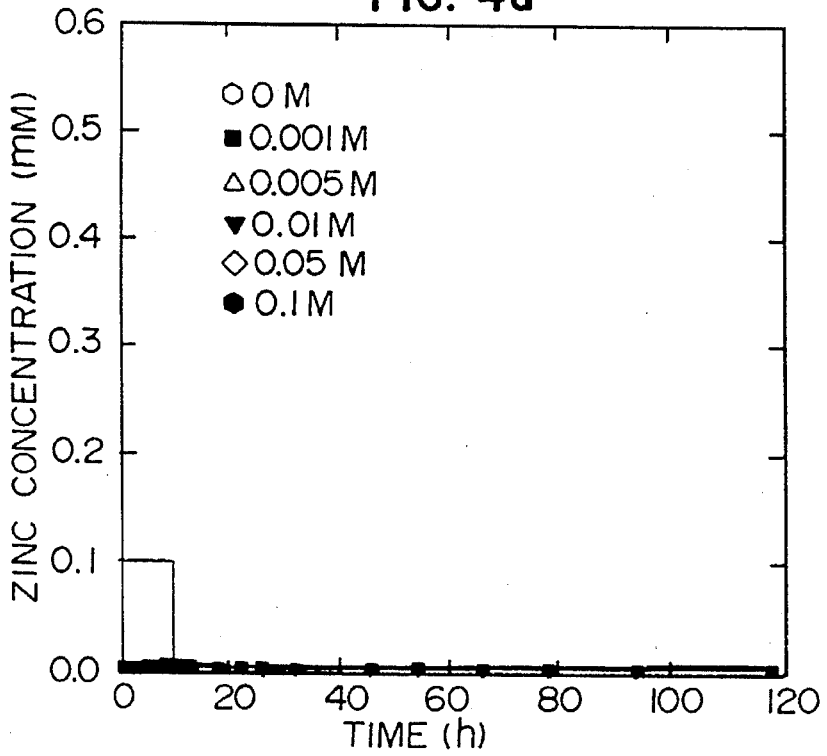
FIGS. 4(*a*) and 4(*b*) illustrate dissolved zinc(II) concentrations observed during treatment of brass fixture bodies with various cupric acetate/acetic acid and acetic acid solutions (pH 4) under closed loop dynamic conditions.
Figure 4B:
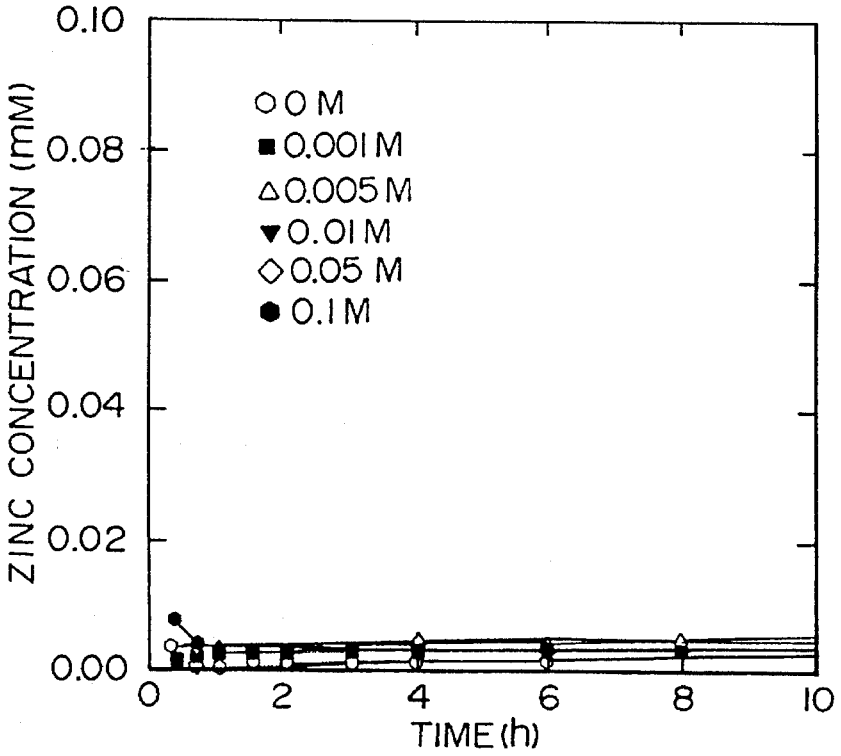
Figure 5A:
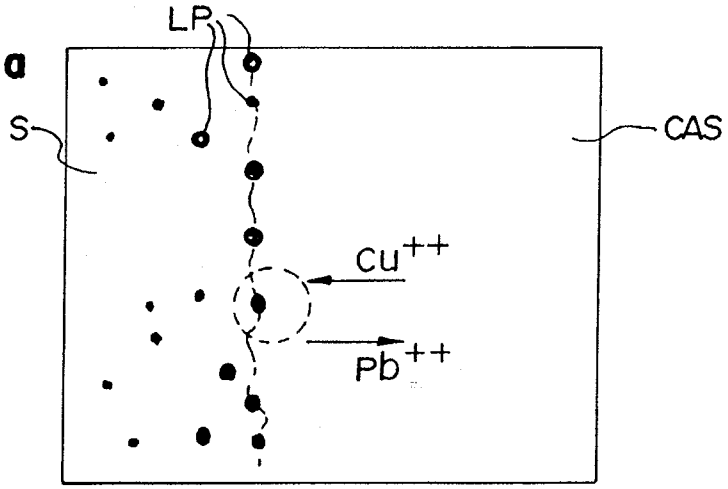
FIG. 5(*a*) is a schematic illustration of a brass fixture internal surface having lead pockets LP with enlarged schematics (FIGS. 5(*b*) and 5(*c*)) illustrating copper and lead interchange during treatment with an adjacent cupric acetate/acetic acid solution CAS to produce a porous deleadified layer PDL.
Figure 5B:
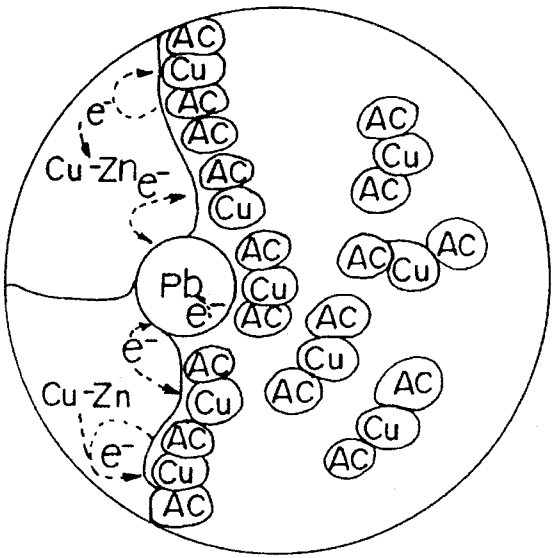
Figure 5C:
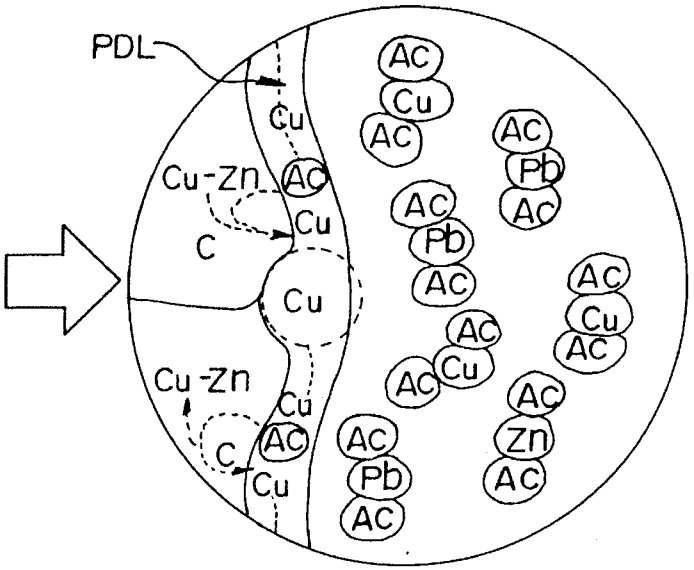

The $CuAc_2$ concentrations used were 0M (control), 0.001M, 0.005M, 0.01M, 0.05M, 0.1M. Lead concentrations in the treatment solutions at the end of the treatment period were generally less than 0.1M, while zinc concentrations were generally less than about 0.005M. The concentrations of lead and zinc are shown in the graphs of FIGS. 3 and 4. These show that substantial amounts of the lead are removed in the very early stages of treatment, and that little lead is removed after the first several hours of treatment.

EXAMPLE 2

Figure 7A:
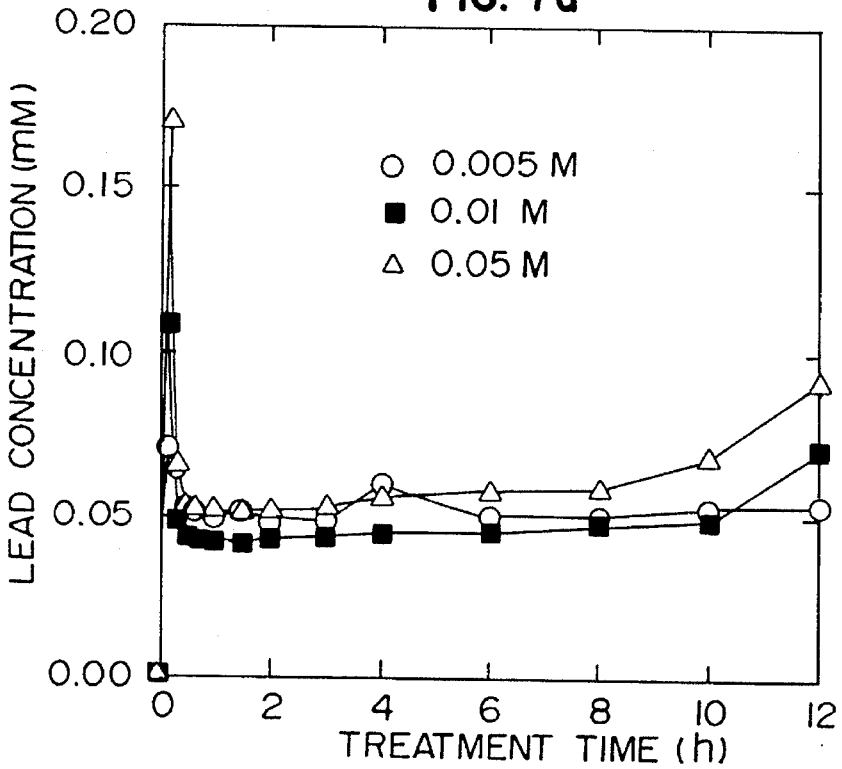
FIG. 7 illustrates dissolved lead(II) and zinc(II) concentrations observed during treatment of brass fixture bodies with various cupric acetate/acetic acid solutions (at a pH of 4) under closed loop dynamic conditions (samples taken from return line).
Figure 7B:
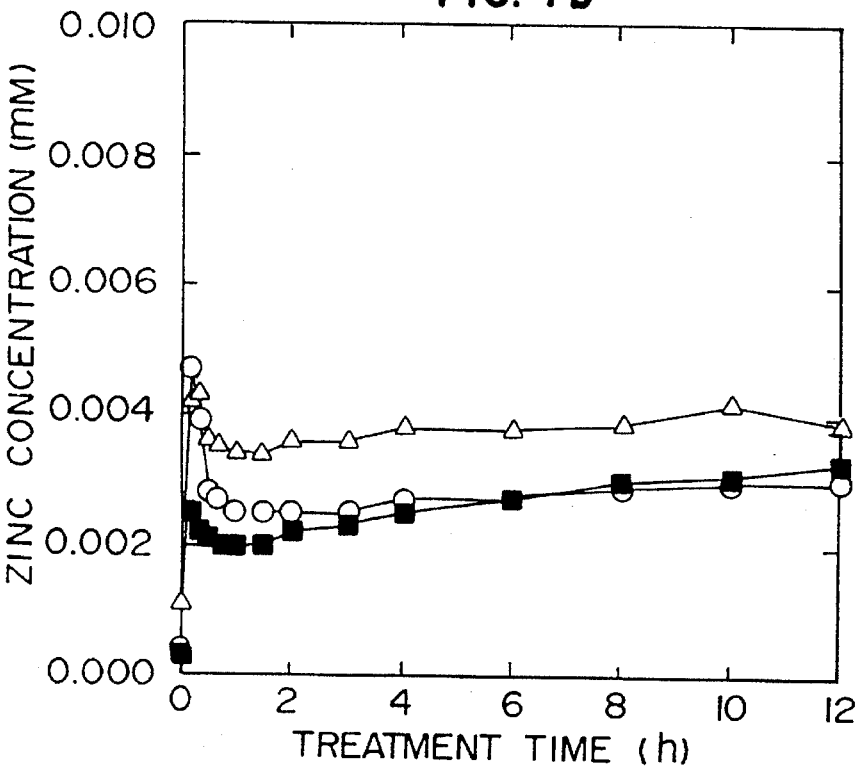

Three brass fixture bodies were treated dynamically with 20 liters of a recirculating copper acetate solution at a pH of 4 in the same manner described above. Treatment time was 12 hours at 23° C. $CuAc_2$ concentration was 5 millimolar (mM), 10 mM and 50 mM. Lead concentration in the copper acetate solution returning from the fixture bodies was high in the very early, initial treatment stages, but decreased to less than 0.10 mM lead within 20 minutes. Zinc concentration was generally less than 0.004 mM in the treatment solutions, showing that dezincification was minor and that the process was largely selective for lead. The treatment results are shown by FIG. 7. The pH of the bath remained essentially 4.0 due to the buffering by the acetic acid.

EXAMPLE 3

Example 2 was repeated, using only the 0.01 M $CuAc_2$ solution. Three replicates were treated, varying the gas used, namely nitrogen, air, and none (open to the atmosphere). Results were similar to the 0.01M $CuAc_2$ experiment of Example 2. Lead concentration in the treatment solution was initially high, but decreased to less than 0.06 mM within an hour, while zinc concentration was generally less than 0.004 mM for the first four hours and less than 0.005 mM after 12 hours.

Additional tests were conducted to ascertain whether the treated brass fittings satisfied the newer standards required for lead removal for fittings to be used for potable water service. Under NSF Standard NSF 61, Section 9-1994, the permissible amount of lead in samples of water is 11 μg when normalized for one liter first draw sample from the fitting. This amount of lead is based on testing a sampling of fittings to determine the lead leaching concentrations over time. Assuming the lead leaching concentrations are log-normally distributed, a derived test statistic Q is calculated. Q is an exact 90% upper confidence bound on the 75th percentile fitting dosage and should be no more than 11 μg for the product line to be acceptable. In other words, according to NSF-61, Section 9-1994, Q provides an estimate of lead-leaching concentrations for the whole line of fittings based on a small sample.

EXAMPLE 4

A comparative test was undertaken on a permanent molded centerset body using, for the dose of water, a 70% faucet volume for cold-mix adjustment. Three such faucets which had been treated for lead passivation and removal as described above were tested as well as three untreated faucets. Values were as follows. As will be seen, the test statistic Q calculated for the treated faucets was well within the maximum 11 μg range, whereas Q for the the untreated faucets fell outside the permitted range, all according to NSF-61.

TREATED FAUCETS (EXAMPLE 4)

| | lead dosage (μg) | | | ln (μg) | | |
|---|---|---|---|---|---|---|
| Day | A | B | C | A | B | C |
| 3 | 2.1 | 1.4 | 1.4 | 0.742 | 0.336 | 0.336 |
| 4 | 1.4 | 1.4 | 1.4 | 0.336 | 0.336 | 0.336 |
| 5 | 1.4 | 1.4 | 0.7 | 0.336 | 0.336 | −0.357 |
| 10 | 1.4 | 0.7 | 0.7 | 0.336 | −0.357 | −0.357 |
| 11 | 1.4 | 0.7 | 0.7 | 0.336 | −0.357 | −0.357 |
| 12 | 1.4 | 0.7 | 0.7 | 0.336 | −0.357 | −0.357 |
| 17 | 0.7 | 0.7 | 0.7 | −0.357 | −0.357 | −0.357 |
| 18 | 0.7 | 1.4 | 0.7 | −0.357 | 0.336 | −0.357 |
| 19 | 1.4 | 0.7 | 2.1 | 0.336 | −0.357 | 0.742 |
| Average (log-dosage product mean) | | | | 0.227 | −0.0486 | −0.0806 |
| Average of Average (lead dosage mean) | | | | | | 1.03 |
| Log-Dosage Standard Deviation | | | | | | 1.18 |
| Result (Test Statistic Q) | | | | | | 4.12 |

UNTREATED FAUCETS (EXAMPLE 4)

| | lead dosage (μg) | | | ln (μg) | | |
|---|---|---|---|---|---|---|
| Day | D | E | F | D | E | F |
| 3 | 17.5 | 11.2 | 11.9 | 2.86 | 2.42 | 2.48 |
| 4 | 18.2 | 19.6 | 18.2 | 2.90 | 2.98 | 2.90 |
| 5 | 15.4 | 18.2 | 18.9 | 2.73 | 2.90 | 2.94 |
| 10 | 16.1 | 11.9 | 11.9 | 2.78 | 2.48 | 2.48 |
| 11 | 13.3 | 11.9 | 21.0 | 2.59 | 2.48 | 3.04 |
| 12 | 16.8 | 18.2 | 21.0 | 2.82 | 2.90 | 3.04 |
| 17 | 10.5 | 14.0 | 14.7 | 2.35 | 2.64 | 2.69 |
| 18 | 8.4 | 7.7 | 7.7 | 2.13 | 2.04 | 2.04 |
| 19 | 8.4 | 7.7 | 10.5 | 2.13 | 2.04 | 2.35 |
| Average (log-dosage product mean) | | | | 2.59 | 2.54 | 2.66 |
| Average of Average (lead dosage mean) | | | | | | 13.4 |
| Log-Dosage Standard Deviation | | | | | | 1.06 |
| Result (Test Statistic Q) | | | | | | 16.2 |

EXAMPLE 5

A further set of tests was conducted on a sand cast body with a kitchen spout, again at a dose of water taken from the faucets set at 70% of faucet volume and at the cold-mix adjustment. The treated faucets fell well within the permitted range of 11 μg, whereas the untreated faucets were well outside the permitted range according to the NSF Standard NSF-61.

TREATED FAUCETS (EXAMPLE 5)

| Day | lead dosage (μg) A | B | C | ln (μg) A | B | C |
|---|---|---|---|---|---|---|
| 3 | 10.5 | 15.4 | 9.1 | 2.35 | 2.73 | 2.21 |
| 4 | 4.9 | 8.4 | 7.7 | 1.59 | 2.13 | 2.04 |
| 5 | 4.2 | 7.7 | 5.6 | 1.44 | 2.04 | 1.72 |
| 10 | 3.5 | 4.9 | 8.4 | 1.25 | 1.59 | 2.13 |
| 11 | 4.9 | 9.1 | 8.4 | 1.59 | 2.21 | 2.13 |
| 12 | 5.6 | 6.3 | 4.2 | 1.72 | 1.84 | 1.43 |
| 17 | 2.1 | 2.8 | 5.6 | 0.742 | 1.03 | 1.72 |
| 18 | 2.1 | 2.8 | 5.6 | 0.742 | 1.03 | 1.72 |
| 19 | 5.6 | 7.0 | 7.0 | 1.72 | 1.95 | 1.95 |
| Average (log-dosage product mean) | | | | 1.46 | 1.84 | 1.90 |
| Average of Average (lead dosage mean) | | | | | | 5.65 |
| Log-Dosage Standard Deviation | | | | | | 1.27 |
| Result (Test Statistic Q) | | | | | | 8.94 |

TREATED FAUCETS (EXAMPLE 6)

| Day | lead dosage (μg) A | B | C | ln (μg) A | B | C |
|---|---|---|---|---|---|---|
| 3 | 7.49 | 9.24 | 10.4 | 2.01 | 2.22 | 2.34 |
| 4 | 7.87 | 8.49 | 10.2 | 2.06 | 2.14 | 2.33 |
| 5 | 7.74 | 8.87 | 7.62 | 2.05 | 2.18 | 2.03 |
| 10 | 1.00 | 1.19 | 1.25 | 0.001 | 0.171 | 0.222 |
| 11 | 0.624 | 0.624 | 0.624 | −0.471 | −0.471 | −0.471 |
| 12 | 0.624 | 0.624 | 0.649 | −0.471 | −0.471 | −0.432 |
| 17 | 0.624 | 0.624 | 1.00 | −0.471 | −0.471 | 0.001 |
| 18 | 1.25 | 1.62 | 0.624 | 0.222 | 0.485 | −0.471 |
| 19 | 0.624 | 0.624 | 0.624 | −0.471 | −0.471 | −0.471 |
| Average (log-dosage product mean) | | | | 0.496 | 0.591 | 0.564 |
| Average of Average (lead dosage mean) | | | | | | 1.73 |
| Log-Dosage Standard Deviation | | | | | | 1.05 |
| Result (Test Statistic Q) | | | | | | 4.47 |

UNTREATED FAUCETS (EXAMPLE 5)

| Day | D | E | F | G | H | I | J | K | L | M |
|---|---|---|---|---|---|---|---|---|---|---|
| | | | | | Lead dosage (μg) | | | | | |
| 3 | 42.7 | 60.2 | 67.9 | 74.2 | 140 | 67.9 | 95.9 | 32.9 | 16.1 | 55.44 |
| 4 | 92.4 | 76.3 | 57.4 | 95.2 | 72.8 | 49.7 | 23.1 | 35.7 | 55.3 | |
| 5 | 53.9 | 49.7 | 46.2 | 91.7 | 53.2 | 53.2 | 18.2 | 22.4 | 25.9 | |
| 10 | 51.1 | 44.1 | 52.5 | 50.4 | 49 | 47.6 | 19.6 | 12.6 | 24.5 | |
| 11 | 42.7 | 44.1 | 39.9 | 44.1 | 47.6 | 42.7 | 11.2 | 7 | 13.3 | 60.48 |
| 12 | 44.8 | 38.5 | 44.8 | 36.4 | 51.1 | 46.9 | 25.9 | 53.9 | 84.7 | |
| 17 | 44.1 | 45.5 | 42 | 46.9 | 51.1 | 45.5 | 36.4 | 26.6 | 37.1 | |
| 18 | 43.4 | 42 | 39.9 | 41.3 | 38.5 | 31.5 | 8.4 | 7.7 | 16.8 | |
| 19 | 36.4 | 37.8 | 40.6 | 44.1 | 44.8 | 37.1 | 39.9 | 28 | 8.4 | 81.9 |
| | | | | | Log (ln) of lead dosage (μg) | | | | | |
| 3 | 3.75 | 4.10 | 4.22 | 4.31 | 4.94 | 4.22 | 4.56 | 3.49 | 2.78 | 4.02 |
| 4 | 4.53 | 4.33 | 4.05 | 4.56 | 4.29 | 3.91 | 3.14 | 3.58 | 4.01 | |
| 5 | 3.99 | 3.91 | 3.83 | 4.52 | 3.97 | 3.97 | 2.90 | 3.11 | 3.25 | |
| 10 | 3.93 | 3.79 | 3.96 | 3.92 | 3.89 | 3.86 | 2.98 | 2.53 | 3.20 | |
| 11 | 3.75 | 3.79 | 3.69 | 3.79 | 3.86 | 3.75 | 2.42 | 1.95 | 2.59 | 4.10 |
| 12 | 3.80 | 3.65 | 3.80 | 3.59 | 3.93 | 3.85 | 3.25 | 3.99 | 4.44 | |
| 17 | 3.79 | 3.82 | 3.74 | 3.85 | 3.93 | 3.82 | 3.59 | 3.28 | 3.61 | |
| 18 | 3.77 | 3.74 | 3.69 | 3.72 | 3.65 | 3.45 | 2.13 | 2.04 | 2.82 | |
| 19 | 3.59 | 3.63 | 3.70 | 3.79 | 3.80 | 3.61 | 3.69 | 3.33 | 2.13 | 4.41 |
| | | | | | Average of Log (ln) of lead dosage (μg) | | | | | |
| | 3.88 | 3.86 | 3.85 | 4.00 | 4.03 | 3.83 | 3.18 | 3.03 | 3.20 | 4.18 |
| Average (Log Dosage Product Mean) | | | | | | | | | | 3.70 |
| Average of Average (Lead Dosage Mean) | | | | | | | | | | 40.7 |
| Log Dosage Standard Deviation | | | | | | | | | | 1.50 |
| Result (Test Statistic Q) | | | | | | | | | | 42.5 |

Still further brass fittings treated with $CuAc_2$ according to the process described above were tested according to the NSF Standard NSF-61. Each of the tests demonstrated that the process had reduced lead leaching to a level at which the treated fillings fell well within the permitted range of 11 μg.

EXAMPLE 6

A permanent molded centerset lavatory faucet set at a 70% cold-mix volume of 124.8912 ml was subjected to testing and produced the following results. The sensitivity of the test is limited so that normalized values cannot be measured to less than 0.624 μg. Thus, the test statistic Q is probably even lower than that calculated.

EXAMPLE 7

A decorator center set lavatory faucet set at a 70% cold-mix volume of 124.8917 ml was subjected to testing and produced the following results.

TREATED FAUCETS (EXAMPLE 7)

| Day | lead dosage (μg) A | B | C | ln (μg) A | B | C |
|---|---|---|---|---|---|---|
| 3 | 15.0 | 18.7 | 17.5 | 2.71 | 2.93 | 2.86 |
| 4 | 13.7 | 18.7 | 15.0 | 2.62 | 2.93 | 2.71 |
| 5 | 12.5 | 13.7 | 12.4 | 2.52 | 2.62 | 2.51 |
| 10 | 2.50 | 1.87 | 1.37 | 0.915 | 0.628 | 0.318 |
| 11 | 1.25 | 1.50 | 0.624 | 0.222 | 0.405 | −0.471 |

-continued

| TREATED FAUCETS (EXAMPLE 7) | | | | | | |
|---|---|---|---|---|---|---|
| | lead dosage (μg) | | | ln (μg) | | |
| Day | A | B | C | A | B | C |
| 12 | 1.10 | 1.25 | 0.624 | 0.0944 | 0.222 | −0.471 |
| 17 | 0.749 | 0.999 | 0.624 | −0.288 | 0.009 | −0.471 |
| 18 | 0.874 | 0.749 | 0.624 | −0.134 | −0.288 | −0.471 |
| 19 | 1.12 | 0.624 | 0.624 | 0.117 | −0.471 | −0.471 |
| Average (log-dosage product mean) | | | | 0.975 | 0.997 | 0.672 |
| Average of Average (lead dosage mean) | | | | | | 2.41 |
| Log-Dosage Standard Deviation | | | | | | 1.20 |
| Result (Test Statistic Q) | | | | | | 5.54 |

EXAMPLE 8

A two-handle deck mount sink faucet with cast spout set at a 70% cold-mix volume of 216.1841 ml was treated with $CuAc_2$ and subjected to testing and produced the following results.

| TREATED FAUCETS (EXAMPLE 8) | | | | | | |
|---|---|---|---|---|---|---|
| | lead dosage (μg) | | | ln (μg) | | |
| Day | A | B | C | A | B | C |
| 3 | 20.5 | 23.8 | 18.8 | 3.02 | 3.17 | 2.93 |
| 4 | 19.7 | 21.2 | 17.1 | 2.98 | 3.05 | 2.84 |
| 5 | 17.9 | 18.6 | 15.3 | 2.89 | 2.92 | 2.73 |
| 10 | 9.73 | 4.76 | 5.84 | 2.28 | 1.56 | 1.76 |
| 11 | 1.60 | 2.10 | 1.88 | 0.470 | 0.740 | 0.632 |
| 12 | 2.38 | 1.66 | 1.73 | 0.866 | 0.510 | 0.548 |
| 17 | 1.08 | 1.95 | 1.51 | 0.0778 | 0.666 | 0.414 |
| 18 | 6.27 | 5.62 | 4.32 | 1.84 | 1.73 | 1.46 |
| 19 | 1.08 | 1.73 | 3.89 | 0.0778 | 0.548 | 1.36 |
| Average (log-dosage product mean) | | | | 1.61 | 1.65 | 1.63 |
| Average of Average (lead dosage mean) | | | | | | 5.12 |
| Log-Dosage Standard Deviation | | | | | | 1.02 |
| Result (Test Statistic Q) | | | | | | 7.78 |

EXAMPLE 9

A two-handle deck mount sink faucet with tubular spout set at a 70% cold-mix volume of 182.5846 ml was treated with $CuAc_2$ and subjected to testing and produced the following results.

| TREATED FAUCETS (EXAMPLE 9) | | | | | | |
|---|---|---|---|---|---|---|
| | lead dosage (μg) | | | ln (μg) | | |
| Day | A | B | C | A | B | C |
| 3 | 5.66 | 4.93 | 6.03 | 1.73 | 1.60 | 1.80 |
| 4 | 6.57 | 3.29 | 29.2 | 1.88 | 1.19 | 3.37 |
| 5 | 4.92 | 5.48 | 3.29 | 1.60 | 1.70 | 1.19 |
| 10 | 31.47 | 2.01 | 1.10 | 1.24 | 0.697 | 0.0912 |
| 11 | 1.15 | 1.02 | 1.83 | 0.14 | 0.0222 | 0.602 |
| 12 | 3.65 | 1.46 | 0.912 | 1.30 | 0.379 | −0.0911 |
| 17 | 1.28 | 1.46 | 1.64 | 0.245 | 0.379 | 0.497 |
| 18 | 4.38 | 2.92 | 1.28 | 1.48 | 1.07 | 0.245 |
| 19 | 1.83 | 0.913 | 20.2 | 0.602 | −0.0911 | 3.00 |
| Average (log-dosage product mean) | | | | 1.14 | 0.772 | 1.19 |
| Average of Average (lead dosage mean) | | | | | | 2.81 |
| Log-Dosage Standard Deviation | | | | | | 1.26 |
| Result (Test Statistic Q) | | | | | | 6.07 |

Using $CuAc_2$ to treat lead-containing surfaces is believed to be versatile. Surfaces may be subjected to immersion in a $CuAc_2$ solution, or the $CuAc_2$ solution may be passed through brass fittings or an existing installation to treat, for example, the lead in otherwise inaccessible pipes. After treatment, the $CuAc_2$ solution is flushed from the treated parts, removing any leached lead, as well as removing the remaining copper and acetate ions.

Figure 1A:
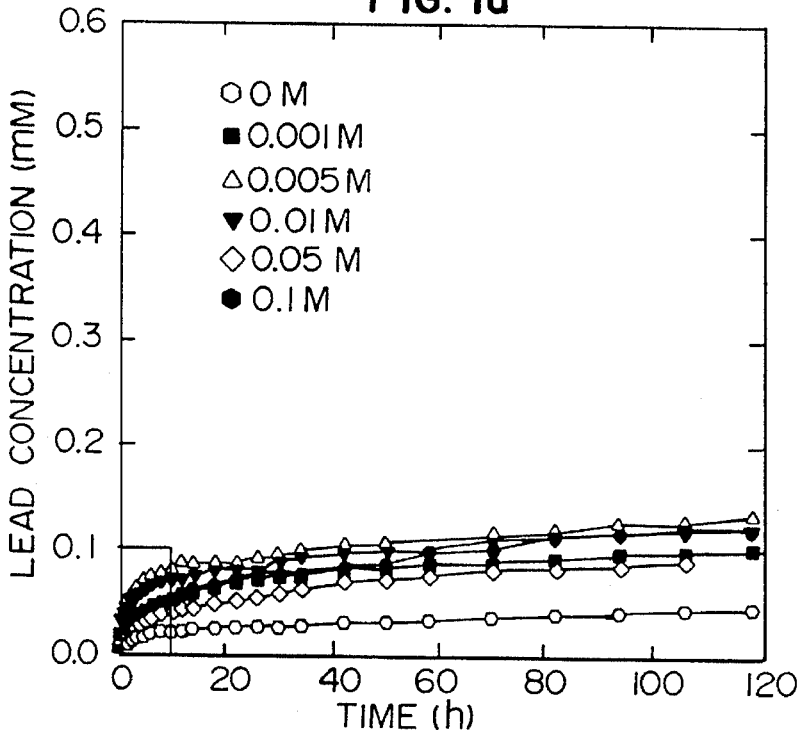
FIGS. 1(*a*) and 1(*b*) illustrate dissolved lead(II) concentration observed during treatment of brass fixture bodies with various cupric chloride/hydrochloric acid and hydrochloric acid solutions (all at pH 2) under closed loop dynamic conditions.
Figure 1B:
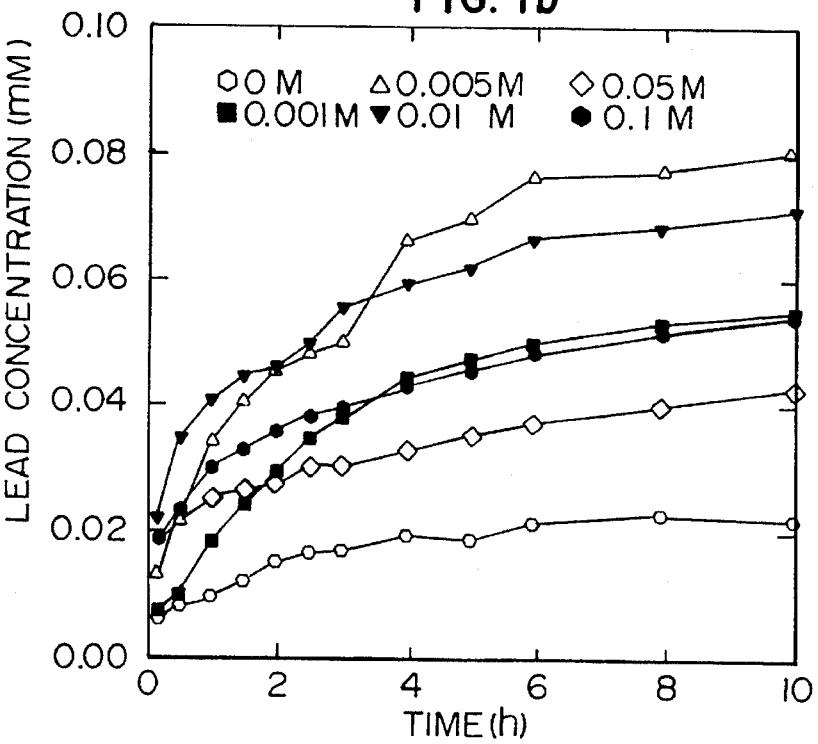

As shown by FIGS. 1(*a*)–4(*b*), copper acetate usage is very effective and minimizes dezincification as well as compared to prior copper chloride experiments. Thus, copper acetate treatments show substantial improvement over the copper chloride treatments in the specific removal of lead, while leaching only very low amounts of zinc. This can best be seen by comparing FIGS. 1 and 2 with FIGS. 3 and 4. These treatments involved returning the treatment solutions to the treatment solution reservoirs (i.e., closed loop dynamic operation) of the type shown in FIG. 6. Other dynamic treatments were performed without recirculation to maintain the lead concentration entering the fixture body at a fixed level, usually zero, during the treatment (i.e., single pass).

Figure 2A:
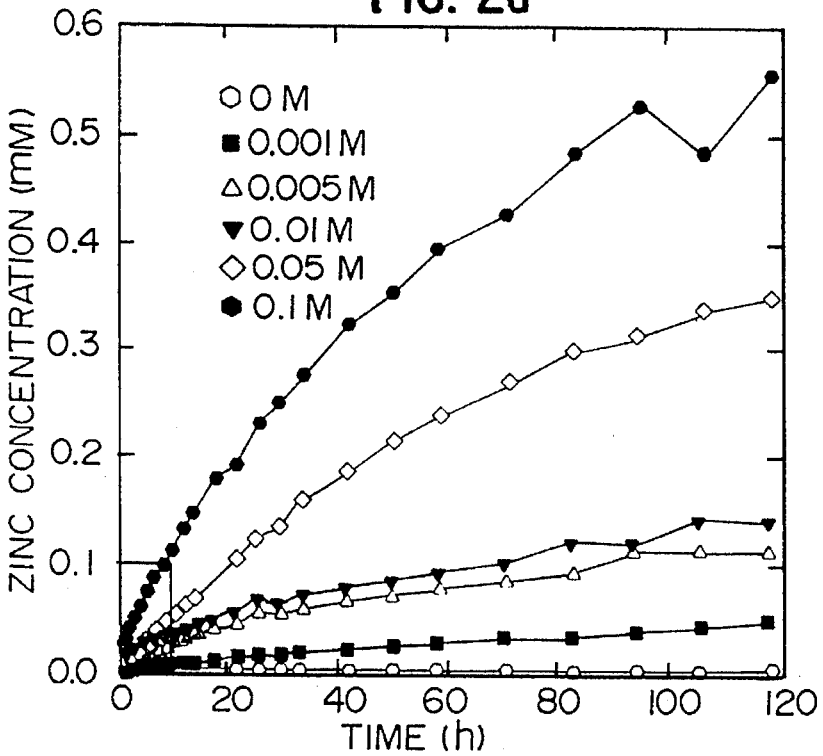
FIGS. 2(*a*) and 2(*b*) illustrate dissolved zinc(II) concentrations observed during treatment of brass fixture bodies with various cupric chloride/hydrochloric acid and hydrochloric acid solutions (all at pH 2) under closed loop dynamic conditions.
Figure 2B:
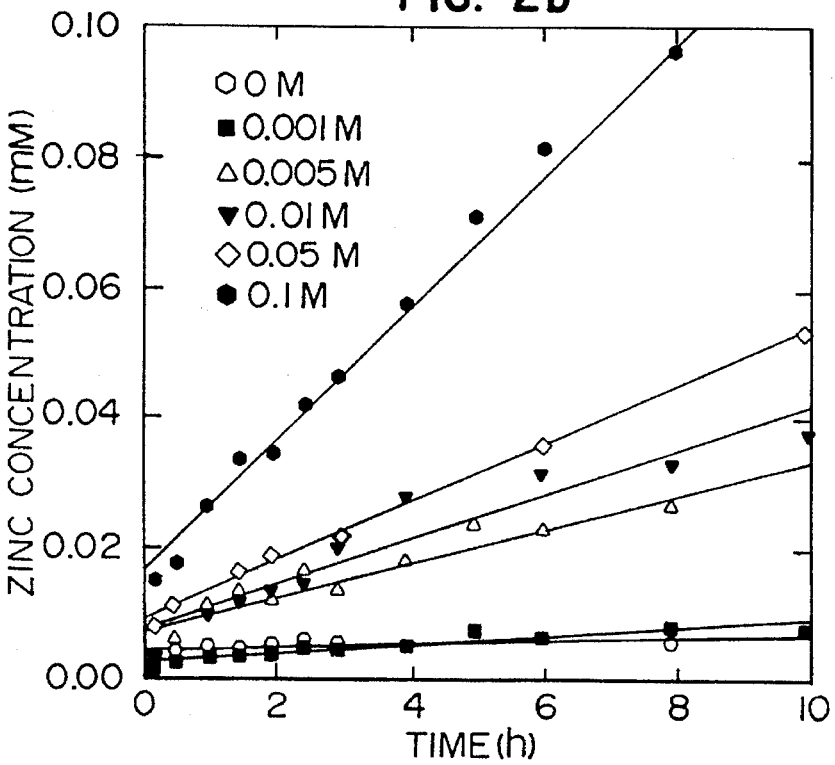

FIGS. 1(*a*) and 1(*b*) illustrate the dissolved lead (II) concentrations observed during treatment of brass fixture bodies with various cupric chloride/hydrochloride acid and control (HCl alone) solutions at pH 2 under closed loop dynamic conditions, while FIGS. 2(*a*) and 2(*b*) illustrates the dissolved zinc (II) concentrations observed during the same treatments in various cupric chloride/hydrochloride and control (HCl alone) solutions (pH 2) under closed loop dynamic conditions. FIGS. 1(*b*) and 2(*b*) are enlarged views of the first ten hours of the 120 hour treatment.

FIGS. 3(*a*) and 3(*b*) illustrate the dissolved lead (II) concentrations observed during treatment of brass fixture bodies with various cupric acetate/acetic acid and control (acetic acid alone) solutions (pH 4) under closed loop dynamic conditions, while FIGS. 4(*a*) and 4(*b*) illustrate the dissolved zinc (II) concentrations observed during the same treatments. FIGS. 3(*b*) and 4(*b*) are enlarged views of the first ten hours of the 120 hour treatment.

Although the foregoing examples used $CuAc_2$, it is believed that copper salts of other carboxylic acids will be suitable, including citrates, fumarates, maleares, succinates, malonates, isocitrates, malates, oxalates, pyruvates and salicylates. Indeed, it is hypothesized that copper salts of carboxylic acids having two carboxyl groups, such as oxalate, or having a carboxyl and a hydroxyl group, such as salicylate, may be even more effective.

An additional aspect of the invention involves removing lead from the treatment solution. The flushed treatment solution, in the case of existing installations, or the "spent" treatment solution, in the case of fittings treated before installation, may preferably be treated to be recharged and regenerated. This treatment also results in removing the lead from the solution, and concentrating the lead into a solid phase, making disposal of the lead easier.

It has further been discovered that a particular resin, the strong cation exchange resin Amberlite 200 (Rohm & Haas) having a degree of about twenty percent cross-link and a macroreticular structure is a highly suitable resin for removing lead from the treatment solution. This resin is highly selective for lead in a lead-copper solution.

EXAMPLE 10

Amberlite 200, Cu(II) form, was used in a test. A two milliliter volume of the resin in the copper form was added to 960 ml of solutions containing various mixtures of $PbAc_2$ and $CuAc_2$, pH 4, in one-liter glass bottles. The bottles were stoppered tightly and shaken intermittently for at least 5 days.

Five isotherms (at 30° C. and pH 4) were performed with chloride salts at three different total metal ion concentrations of 0.002 normality (0.002N), 0.004N, and 0.01N (corresponding to molarities of 0.001M, 0.002M, and 0.005M, respectively), and acetate salts at two different total metal concentrations of 0.002N and 0.01N (corresponding to molarities of 0.001M and 0.005M). Additional experiments were performed with acetate salts at total metal concentrations of 0.01M and 0.05M.

Figure 8A:
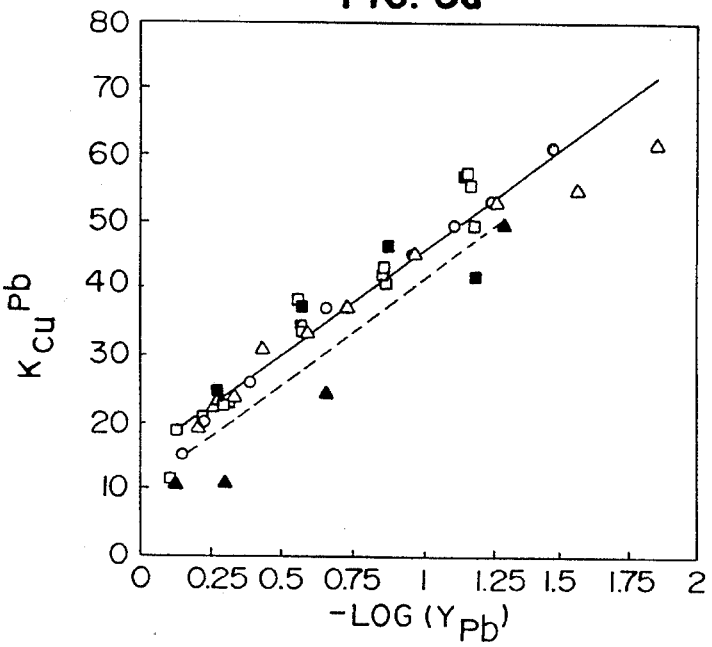
FIGS. 8(*a*) and (*b*) illustrate the selectivity coefficient and isotherms of lead over copper of Amberlite 200 resin.
Figure 8B:
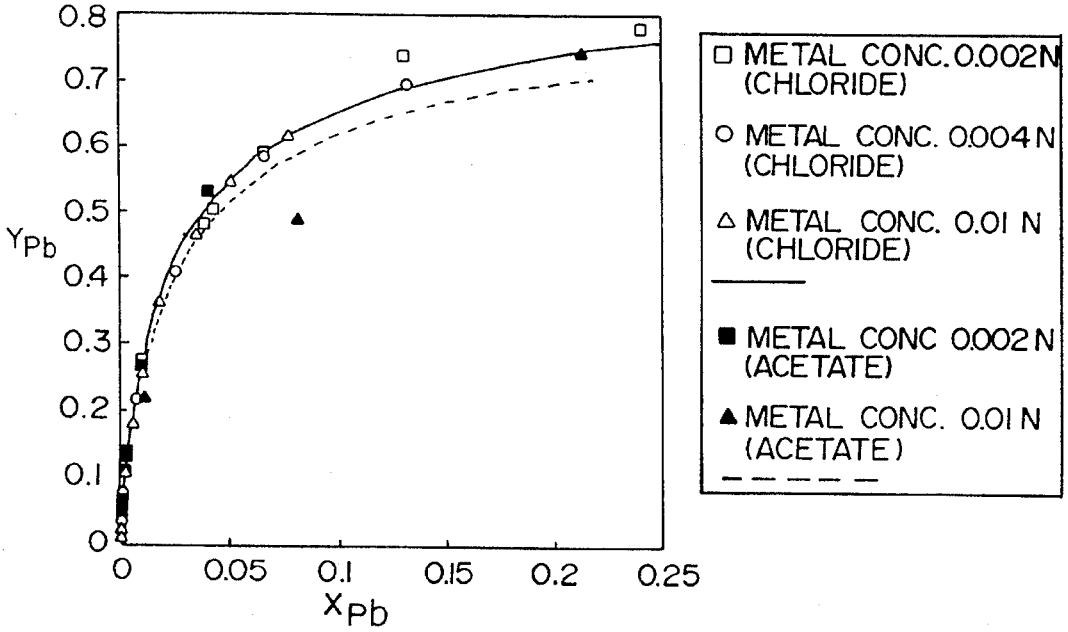

The graph, FIG. 8(*a*), shows that the selectivity coefficient of lead over copper is high in all solutions. The isotherms (FIG. 8(*b*)) demonstrate that Amberlite 200 resin should work well under conditions of fixture treatment.

Additionally, although Amberlite 200 is the preferred resin, other resins may be suitable for ion-exchange of copper and lead in the treatment solution.

It will be apparent to those skilled in the art that further modifications may be made without departing from the spirit and scope of the present invention. Accordingly, the claims are intended to embrace all modifications within their scope.

What is claimed is:

1. A method of treating a lead-containing copper-based alloy body to reduce the availability of lead to be removed therefrom comprising the steps of:

providing a $CuAc_2$ solution at a pH in the range of from about 3 to about 5 and at a $CuAc_2$ molar concentration of from about 0.001M to about 0.1M;

subjecting the alloy body to the $CuAc_2$ solution for a period of time effective to reduce the availability of lead; and washing the alloy body to remove the $CuAc_2$ solution.

2. The method of claim 1, and further comprising subjecting the alloy body to the $CuAc_2$ solution for a period of at least 5 minutes.

3. The method of claim 2, and further comprising subjecting the alloy body to the $CuAc_2$ solution for a period of at least 20 minutes.

4. The method of claim 1, and further comprising providing a $CuAc_2$ solution at a pH in the range of from about 3.5 to about 4.5.

5. The method of claim 4, and further comprising providing a $CuAc_2$ solution of a pH of about 4.

6. The method of claim 1, and wherein the $CuAc_2$ molar concentration is from at least about 0.01M to about 0.05M.

7. The method of claim 1, and wherein the $CuAc_2$ molar concentration is from at least about 0.01M to about 0.02M.

8. The method of claim 1, and comprising the further step of regenerating the $CuAc_2$ solution using an ion exchange column.

9. The method of claim 1, and wherein the alloy is selected from the group consisting of bronze and brass.

10. A method of treating brass fittings having an interior lead-containing surface to passivate and remove the lead to reduce the availability of lead to be removed therefrom by potable water passing through the fittings when installed in a service environment comprising the steps of:

providing a $CuAc_2$ solution at a pH in the range of from about 3 to about 5 and at a $CuAc_2$ molar concentration of from about 0,001M to about 0.1M;

subjecting the interior lead-containing surface to said $CuAc_2$ solution for a period of at least about 5 minutes; and washing the surfaces to remove the $CuAc_2$ solution.

11. The method of claim 10, and further comprising subjecting the lead-containing surface to the $CuAc_2$ solution for a period of at least 20 minutes.

12. The method of claim 10, and further comprising providing a $CuAc_2$ solution at a pH of from about 3.5 to about 4.5.

13. The method of claim 10, and further comprising providing a $CuAc_2$ solution of a pH of about 4.

14. The method of claim 10, and wherein the $CuAc_2$ molar concentration is from about 0.01M to about 0.05M.

15. The method of claim 10, and wherein the $CuAc_2$ molar concentration is from about 0.01M to about 0.02M.

16. The method of claim 10, and comprising the further step of regenerating the $CuAc_2$ solution using an ion exchange column.

17. A method of treating a lead-containing copper-based alloy body to reduce the availability of lead to be removed therefrom comprising the steps of:

providing a solution of a copper salt of carboxylic acid at a pH in the range of from about 3 to about 5 and a copper salt molar concentration of from about 0.001M to about 0.1M;

subjecting the alloy body to the solution for a period of at least about 5 minutes; and washing the alloy body to remove the solution.

18. The method of claim 17, and further comprising subjecting the alloy body to the solution for a period of at least 20 minutes.

19. The method of claim 17, and further comprising providing the solution at a pH of from about 3.5 to about 4.5.

20. The method of claim 17, and further comprising providing the solution of a pH of about 4.

21. The method of claim 17, and wherein the copper molar concentration is from about 0.01M to about 0.05M.

22. The method of claim 17, and wherein the copper molar concentration is from about 0.01M to about 0.02M.

23. The method of claim 17, and comprising the further step of regenerating the solution using an ion exchange column.

24. The method of claim 17, and wherein the alloy body is selected from the group consisting of bronze and brass.

25. The method of claim 17, and wherein the copper salt of carboxylic acid is selected from the group consisting of citrates, fumarates, maleates, succinates, malonates, isocitrates, malates, oxalates, pyruvates and salicylates.

26. The method of claim 25, and wherein the copper salt of carboxylic acid is cupric acetate.

* * * * *

UNITED STATES PATENT AND TRADEMARK OFFICE

CERTIFICATE OF CORRECTION

PATENT NO. : 5,601,658

DATED : February 11, 1997

INVENTOR(S) : Benito J. Marinas et al.

It is certified that error appears in the above-indentified patent and that said Letters Patent is hereby corrected as shown below:

Col. 4, lines 44-45, change "$Cu(CH_3COO)_2.H_2O$" to -- $Cu(CH_3COO)_2 \cdot H_2O$ --.

Col. 9, line 60, Example 9, Col. A, change "31.47" to -- 3.47 --.

Col. 10, line 54, change "maleares" to -- maleates --.

Claim 10, Col. 12, line 11, change "0,001M" to -- 0.001M --.

Signed and Sealed this

Seventeenth Day of June, 1997

Bruce Lehman

*Attest:*

BRUCE LEHMAN

*Attesting Officer*

*Commissioner of Patents and Trademarks*